United States Patent [19]

Chao et al.

[11] Patent Number: 4,741,746

[45] Date of Patent: May 3, 1988

[54] ELECTROSTATIC PRECIPITATOR

[75] Inventors: Bei T. Chao; Shao L. Soo, both of Urbana, Ill.

[73] Assignee: University of Illinois, Urbana, Ill.

[21] Appl. No.: 2,368

[22] Filed: Jan. 12, 1987

Related U.S. Application Data

[63] Continuation-in-part of Ser. No. 751,816, Jul. 5, 1985, abandoned.

[51] Int. Cl.[4] ..... B03C 3/80

[52] U.S. Cl. ..... 55/117; 55/146; 55/152; 55/154; 55/DIG. 30

[58] Field of Search ..... 55/117, 120, 140, 146, 55/148, 150, 151, 152, 154, 138, DIG. 30

[56] References Cited

U.S. PATENT DOCUMENTS

| | | | |
|---|---|---|---|
| 617,618 | 1/1899 | Thwaite | 55/152 |
| 1,931,436 | 10/1933 | Deutsch | 55/152 X |
| 1,994,259 | 3/1935 | Thorne | 55/146 X |
| 3,238,702 | 3/1966 | De Seversky | 55/120 X |
| 3,331,192 | 7/1967 | Peterson | 55/146 X |
| 3,526,828 | 9/1970 | Whitby | 55/117 X |
| 3,740,925 | 6/1973 | Gothard | 55/120 X |
| 3,768,258 | 10/1973 | Smith et al. | 55/117 X |
| 4,406,119 | 9/1983 | Kamiya et al. | 55/DIG. 30 X |

FOREIGN PATENT DOCUMENTS

WO84/01602 4/1984 PCT Int'l Appl. ..... 55/120

*Primary Examiner*—Kathleen J. Prunner

*Attorney, Agent, or Firm*—George M. Yahwak; David N. Koffsky

[57] ABSTRACT

An improved exhaust gas particulate removal system is described which includes a corona-charger that is spark-plug like in configuration. The charger includes a central electrode held within an insulating body, a portion of which electrode is recessed in a cavity formed in the insulating body. A very small amount of clean gas is introduced into the cavity in a manner so as to create a spiral vortex flow about the electrode. The swirling gas flow creates an over-pressure which prevents the exhaust particulate matter from depositing on either the needle electrode or the walls of the cavity. Another swirling air flow, surrounding the exterior of the insulating body, is also provided to prevent the formation of a continuous layer of soot deposit thereupon, with the aid of a cylindrical baffle. The charger is juxtaposed to a conductive attractor electrode to create the desired corona for particulate charging and the path of the exhaust flow is passed between the charger and attractor electrodes.

9 Claims, 2 Drawing Sheets

ELECTROSTATIC PRECIPITATOR

REFERENCE TO RELATED APPLICATION

This application is a continuation-in-part of U.S. Pat. Application Ser. No. 751,816 filed July 5, 1985 and now abandoned.

FIELD OF INVENTION

This invention relates to the removal of fine particulate matter from a gaseous stream, and more particularly, to an electrostatic particle charging system for removing particulate matter from a diesel exhaust with special provision for maintaining a corona discharge between electrodes by preventing deposits of particulate matter which could cause shorting between the charging electrode and ground.

BACKGROUND OF THE INVENTION

Electrostatic precipitation is fundamentally different from most other methods of particulate collection in that the forces used to separate the particles from the mainstream are electrical, as opposed to mechanical. These forces act only on the particles themselves and not the entire gas stream resulting in less resistance to mainstream flow.

Electrostatic precipitation consists of three fundamental steps in removing particulate from a gaseous medium. First, the particles are charged to the same sign. Then they are gathered at collection surfaces by means of the forces induced by the electric charge, specifically the Coulomb, image and space charge forces. Finally, the collected mass is removed from the system either by mechanical or thermal means.

The charging is accomplished by applying a high electric potential between two electrodes; one with an extremely small radius of curvature such as a sharp point called the emitting electrode and another with a much larger radius called the attractor electrode. The high intensity electric field thereby created adjacent to the sharp point causes ionization due to collision between fast moving electrons with the gas molecules. Thus, free electrons in the intense electric field act as ionization agents to electrically charge the gas molecules to produce an active or ionization region, known as corona glow. It serves as a copious electron source. If the fine electrode is at negative polarity, the ions become negatively charged. These negative ions propagate out towards the attractor electrode filling the region outside the corona, known as the passive zone, creating a "space charge" with about $10^8$ ions per cubic centimeter at ordinary pressures. As the gas with suspended particles is passed through the passive region of the space-charge field, the particles are subject to an intense barrage of negative ions becoming rapidly negatively charged. Thus the suspended particles acquire the same polarity as the gaseous ions.

It is posssible to have field emission without a corona and momentum exchange may also occur between the free electrons and the gaseous molecules. The charged molecules are, in turn, accelerated away from the emitting electrode causing a noticeable flow of the gas called "electric wind." In U.S. Pat. No. 3,767,258 to Smith, et al., the phenomenon of electric wind is employed to charge the particulate matter in an exhaust stream, however, the surfaces surrounding Smith, et al.'s charging needles are nonconductive thereby preventing the establishment of a corona. Electric wind systems of electrostatic precipitation are generally not accepted as efficient as corona based systems.

In a corona system, as a solid particle enters the space-charge region, it immediately acquires a charge as the gas ions travel along the lines of force in the electric field and converge with the particle. The charging process continues until a sufficient repelling field created by the accumulation of charge has been built up to prevent the ions from reaching the particle. This phenomenon is called saturation.

Particle charging may be carried out by either positive or negative corona discharge. Positive corona discharge is procured by applying a positive voltage to the emitting electrode whereas a negative corona is obtained with a negative emitting electrode. Negative corona is predominantly used in electrostatic precipitation as it is characteristically more stable than a positive corona (e.g. see U.S. Pat. No. 1,931,436 to Deutsch). It is suitable for a gaseous medium which is electronegative. Oxygen, water vapor, carbon dioxide, etc. prevailing in the exhaust of a diesel engine are electronegative gases.

The physical difference between positive and negative corona is that in negative corona, positive ions are attracted to the corona needle and negative ions and electrons are drawn to the attractor electrode. In positive corona, negative ions and electrons are attracted to the corona needle while positive ions propagate to the attractor. The initial source of electrons in positive corona is the electron emission from gas molecules by ultraviolet light quanta while the corona electrode itself is the chief source of electrons in negative corona discharge.

In U.S. Pat. No. 4,435,190 to Taillet, et al., a negative corona system is employed to charge a flow of moist air which is accelerated to supersonic speed resulting in the formation of microparticles of ice. Ions trapped by these microparticles are freed by sublimation to create a flow of space charge which is impelled into the flow containing particulate matter. The particulate matter acquires the desired charged state as it passes through the space charge field. This scheme of using microparticles of ice as ion carriers is to alleviate the reduced efficiency of corona discharge in high temperature applications. (eg. Hot dusty gases at 900° C.).

A major problem incident to many electrostatic systems is the contamination of the charging system by the particulate matter in the exhaust stream (results in arcovers). Taillet, et al. avoids this problem by using an intermediate gas containing microparticles of ice to carry the charge to the exhaust stream. Smith, et al. employs an outwardly directed auxiliary gas flow surrounding his charging needles. The Taillet, et al. system, though complex, is not as efficient as a particle charging system which employs corona discharge. The Smith system does not employ a corona and moreover requires a substantial gas flow to keep the particulate matter away from the charging needles and to alleviate the vacuum which is created by his shielded charging system—which is oriented with its open face directed in the downstream direction.

Others have attempted to prevent contamination through the use of various types of circulating flows of air on other gases about certain surfaces exposed to the particulate matter, e,g. see U.S. Pat. Nos. 3,238,702 to DeSeversky; 1,994,259 to Thorne; and 4,406,119 to Kamiya et al. However, no known contamination prevention system has been devised which enables long term operation of an electrostatic particulate removal system for diesel engines.

OBJECTS OF THE INVENTION

It is an object of this invention to provide an electrostatic exhaust gas charging system wherein the exhaust passes through a space-charge field produced by a negative corona discharge.

A further object of this invention is to provide an electrostatic exhaust gas charging system wherein shorting of electrodes upon prolonged use is prevented.

Still another object of this invention is to provide an electrostatic exhaust gas particulate collection and removal system of high efficiency and durability with small power requirements.

SUMMARY OF THE INVENTION

In accordance with the above objects, an exhaust gas particulate removal system has been developed which includes a charger of novel design. The charger is spark-plug like in configuration, and includes a central needle electrode held within an insulating body, a portion of which electrode is recessed in a cavity formed in the insulating body. A very small amount of clean air is introduced into the cavity in a manner so as to create a spiral vortex flow about the electrode. The swirling gas flow creates an over-pressure within the cavity which effectively prevents the exhaust particulate matter from depositing on the needle electrode and on the walls of the cavity. A swirling air flow, surrounding the exterior of the insulating body, is also provided to prevent the formation of a continuous layer of particulate matter thereon, with the aid of a smoke baffle to reduce the direct impingement of the smoke particles on the insulating body. The charger is juxtaposed to a conductive attractor electrode to create the desired corona for particulate charging. The path of the exhaust flow passes between the charger and attractor electrodes. The swirling cleaning air flows both inside the cavity and outside the insulating body sustain the necessary high electrical resistance between the needle electrode and ground and prevent shorting upon prolonged operation and variable engine loads.

DETAILED DESCRIPTION OF INVENTION

Figures 1, 2:
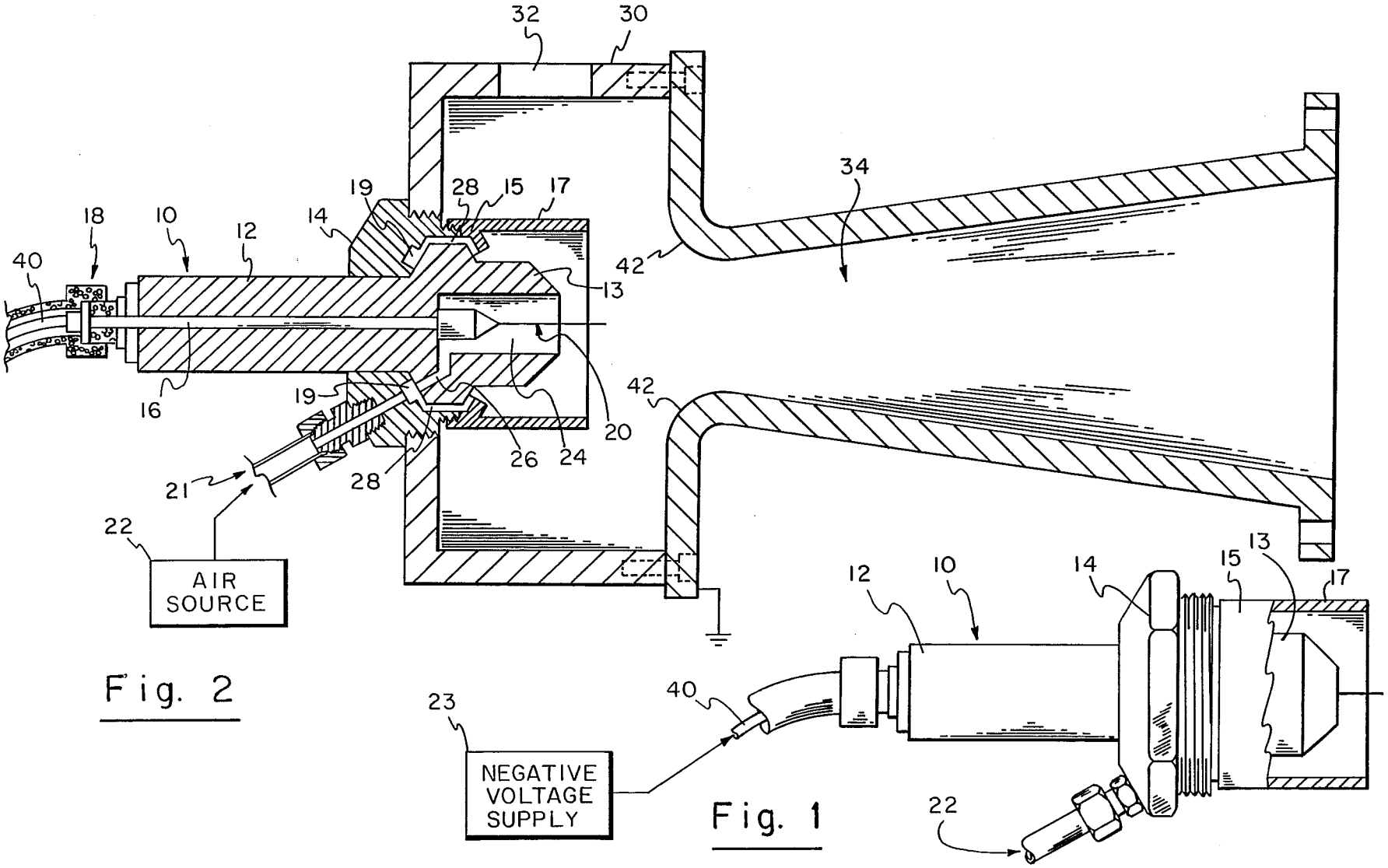
FIG. 1 is an external view of the charger of this invention.
FIG. 2 is a sectional view of the charger in place in an exhaust system.

Referring now to FIGS. 1 and 2, charger 10 is spark-plug like in construction and includes insulator body 12 which is held within threaded steel housing 14 and also includes a threaded retaining cap 15. Conductor 16 is centrally located within insulator body 12 and, at one end connects to a high voltage socket 18 and at the other end to corona needle 20. Corona needle 20 is comprised preferably of tungsten and is of small diameter (e.g. preferably approx 0.5 mm). Central conductor 16 may be copper and insulation body 12 is preferably a nonporous, high temperature, high resistance ceramic such as aluminum oxide or MACOR, a glass-ceramic product of the Corning Glass Company.

Figure 3B:
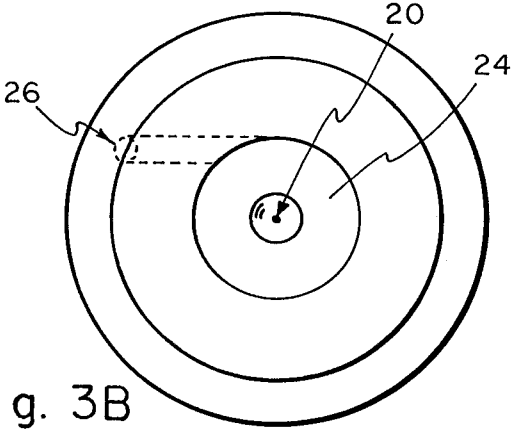
FIGS. 3*a* and 3*b* are schematic views showing details of the air flow passage that produces a spiral vortex flow of cleaning air surrounding the needle electrode.
Figure 3A:
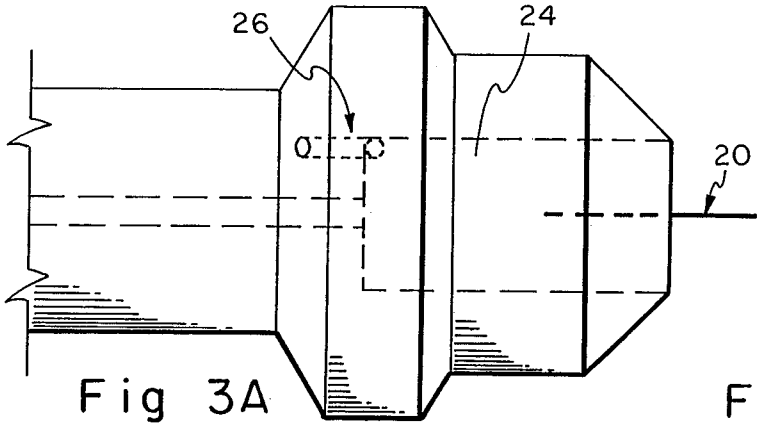

An air passage 21, connected to cleaning air source 22, communictes with cavity 24 via airway 26. As is shown in FIGS. 3*a* and 3*b*, airway 26 opens into cavity 24 at its bottom, offset from the center line thereof and tangential to the side wall of the cavity. When air is introduced into passageway 21, it enters an annular space 19 (FIG. 2) and from there flows into cavity 24 via airways 26. Because of its tangential entry, a helical vortex motion of the cleaning air is created within the cavity, which air eventually exits at the cavity's open end 25. Experiments have demonstrated that the spiral air flow is effective in keeping the walls of cavity 24 free from a continuous layer of particulate matter and in preventing harmful build-up of carbon particles on needly electrode 20.

Airway 26 may be connected to cavity 24 away from its bottom, still offset from its center, so located as to produce a helical vortex flow of maximum effectiveness to prevent particle deposition on the interior walls of the cavity and on needle 20.

Figure 4B:
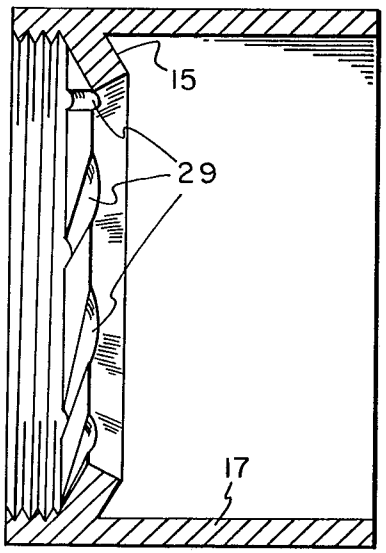
FIGS. 4*a* and 4*b* show details of the cleaning air passages in retaining cap 15.
Figure 4A:
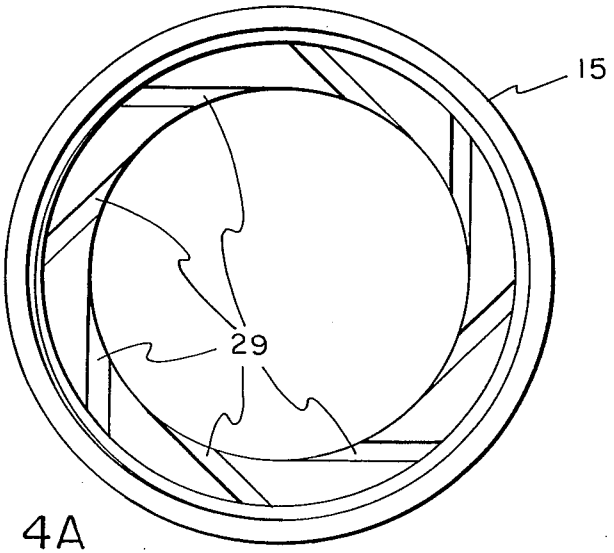

A second cleaning air flow (which is also spiral vortex in motion) surrounds the exterior cylindrical surface 13 of insulating body 12 and discharges tangentially through the eight slots 29 (FIGS. 4*a* and 4*b*) within retaining cap 15. As aforestated, annular space 19 receives its air supply via air passage 21, and in turn communicates with slots 29 via passage 28 in housing 14. The air jets which emerge from slots 29 keep the portion of the cylindrical surface 13 near the root of the insulating body 12 free from carbon deposit. This action is further aided by a smoke baffle 17 integral with cap 15 which prevents direct impingement of the exhaust gas on insulator surface 13 and maintains a helical vortex air flow about surface 13. In this way, a detrimental continuous coating of carbon deposit on surface 13 and the internal surfaces of retaining cap 15 are prevented and high resistance between the needle electrode 20 and ground is preserved during prolonged operation of the device.

Referring back to FIG. 2, charger 10 fits into a threaded opening in exhaust chamber 30. Inlet 32 communicates with the exhaust manifold of a diesel engine (not shown). Surface 42 of the exhaust outlet 34 serves as the attractor electrode for the corona discharge. Outlet 34 may take the form of a flared diffuser to reduce pressure loss or take the form of a simple orifice, forming the attractor. As illustrated in FIG. 2, a flared exhaust outlet opening 34 mates at its anterior end with a parallel plate or other type electrostatic particle collector (not shown). Preferably, the collector plates are of the catalytic type so that entrained particles, once captured, can be readily burned.

A source of high negative potential 23 is applied via high voltage conductor 40 to connector 18 (e.g. 8000–20000 V depending on the configuration of the electrodes) while the walls of exhaust chamber 30 are connected to a source of common potential, usually ground potential. As a result, a corona is created between the tip of needle 20 and conductive shoulder portions 42 of the flared exhaust 34 which forms the exit of chamber 30. In essence, shoulder portions 42 become an attractor electrode and aid in the creation and containment of the corona. When the particle-laden exhaust enters chamber 30, it must travel through the passive region of the corona to reach outlet 34. As a result, the entrained particles in the exhaust gases obtain a substantial negative charge and are subsequently collected downstream on collection plates.

While a source of cleaning air has not been shown in detail, it should be understood by those skilled in the art that any appropriate air source may be utilized, whether it comes from a supercharger, an auxiliary blower or other entity. Furthermore it should be understood that more than one charger may be employed, dependent upon the volume of exhaust gas flow and particulate density.

In laboratory tests over many hours of operation, harmful soot deposits within cavity 24 and upon needle 20 have been prevented by air flows through pathway 26 and soot deposits on the outside surface 13 of the insulating body has been prevented by air flows through slots 29 in retaining cap 15. The total air supply needed for both purposes is small, amounting to 2 to 3 percent of the exhaust gas flow rate. Collection efficiencies of 80% or better of entrained particulate have been achieved.

We claim:

1. An exhaust gas particulate removal system positioned in an exhaust gas pathway, the combination comprising:

attractor electrode means connected to a reference potential;

charger means spaced from said attractor electrode means and connected to a source of high negative potential, the space between said attractor electrode means and said charger means sustaining a corona and encompassing said exhaust gas pathway, said charger means further including:

insulating body means provided with a cylindrical cavity, one end of which is closed and the other end of which is open, a portion of said insulating body means extending into said exhaust gas pathway;

electrode means including a corona needle extending through said insulating body means and said cylindrical cavity, said corona needle axially disposed within said cavity and extending beyond and not touching the open end of said cavity;

first gas passage means communicating with said cavity, said first gas passage means oriented to create a helical/vortex flow of gas within and confined by said cavity and around said corona needle when gas is passed therethrough to prevent deposition of particulate within said cavity and upon said corona needle;

second gas passage means disposed about said portion of said insulating body means which extends into said exhaust gas pathway; and baffle means concentric with the portion of said insulating body means extending into said gas pathway, said baffle means preventing said exhaust gases from directly impinging on said insulating body means and causing the gas flow from said second gas passage means to be confined about said portion of said insulating body means to prevent deposition of a continuous particulate layer thereupon.

2. The invention of claim 1 wherein said second gas passage means provides a helical/vortex gas flow about said portion of said insulating body means.

3. The invention of claim 2 wherein said first and second gas passage means are connected to a source of clean air and said first gas passage means opening into said cavity is substantially tangential to a side wall thereof.

4. The invention of claim 3 wherein said first gas passage means opening is tangential to said closed end of said cylindrical cavity.

5. The invention of claim 1 wherein said attractor electrode means forms an exit for exhaust gases and encompasses said corona needle.

6. A charger for inclusion in an exhaust gas particulate removal system comprising:

insulating body means provided with a cylindrically walled cavity, said cavity having a closed end and an open end; housing means surrounding said insulating body means and adapted to mate with a female opening in said exhaust gas particulate removal system, said housing means including baffle means which encompasses a portion of said insulating body means;

a charging electrode including a corona needle extending through said insulating body means, cavity and said closed and open ends, said corona needle coaxially disposed within said cavity;

a first pressurized air opening in said cavity, said opening oriented to create a helical air flow substantially tangential to a sidewall of said cavity and about said corona needle to prevent the deposition of particulate within said cavity and upon said corona needle; and a set of second pressurized air openings, said openings disposed between said insulating body means and said baffle means to provide a confined helical air flow to prevent the deposition of particulate matter upon said insulating body means.

7. The invention as defined in claim 6 wherein said second set of pressurized air openings are formed as part of said housing means.

8. The invention as defined in claim 7 wherein said first and second pressurized air openings are connected via a common pathway means to a source of pressurized air.

9. The charger of claim 8, wherein said first air openings directs an air flow substantially parallel to said cavity's closed end whereby said sidewall of said cavity prevents said flow of air from diverging from said corona needle.

* * * * *